US006254497B1

(12) United States Patent
Brant et al.

(10) Patent No.: US 6,254,497 B1
(45) Date of Patent: Jul. 3, 2001

(54) METHOD AND APPARATUS FOR SETTING A GOLF BALL AND TEE AND FOR MANAGING A GOLF BALL ON THE GREEN

(76) Inventors: Marion T. Brant, 1722 Larch Ave., Cincinnati, OH (US) 45224; Thomas E. Wagner, 1086 Galbraith Rd., Cincinnati, OH (US) 45231; Ernest D. Siders, 385 No. 3rd St., Williamsburg, OH (US) 45176

( * ) Notice: Subject to any disclaimer, the term of this patent is extended or adjusted under 35 U.S.C. 154(b) by 0 days.

(21) Appl. No.: 09/293,224

(22) Filed: Apr. 16, 1999

Related U.S. Application Data

(60) Provisional application No. 60/082,188, filed on Apr. 17, 1998.

(51) Int. Cl.[7] ..... A63B 57/00
(52) U.S. Cl. ..... 473/386; 473/406
(58) Field of Search ..... 473/386, 286, 473/132; 294/19.1, 19.2

(56) References Cited

U.S. PATENT DOCUMENTS

| | | | | |
|---|---|---|---|---|
| 3,889,946 | | 6/1975 | Setecka . | |
| 3,904,200 | | 9/1975 | Jackle et al. . | |
| 4,277,892 | | 7/1981 | Rushforth . | |
| 4,313,604 | | 2/1982 | Baxter . | |
| 4,360,199 | | 11/1982 | Jackson . | |
| 4,526,369 | * | 7/1985 | Phelps | 473/386 |
| 4,616,826 | | 10/1986 | Trefts . | |
| 4,819,938 | | 4/1989 | Hill . | |
| 4,949,961 | * | 8/1990 | Milano | 473/386 |
| 4,969,646 | | 11/1990 | Tobias . | |
| 5,080,357 | | 1/1992 | Wolf . | |
| 5,165,744 | * | 11/1992 | Vogrin | 473/386 |
| 5,205,598 | | 4/1993 | Miller . | |
| 5,310,177 | | 5/1994 | Conrad et al. . | |
| 5,330,178 | | 7/1994 | Geishert, Sr. . | |
| 5,499,813 | * | 3/1996 | Black | 473/386 |
| 5,503,394 | | 4/1996 | Mauck et al. . | |
| 5,540,432 | | 7/1996 | Keller . | |
| 5,759,117 | * | 6/1998 | Erickson, Jr. | 473/386 |
| 5,839,972 | * | 11/1998 | Swanson | 473/386 |

* cited by examiner

*Primary Examiner*—Steven Wong
(74) *Attorney, Agent, or Firm*—Frost Brown Todd LLC

(57) ABSTRACT

A method and apparatus for setting a golf ball and a golf tee and for managing a golf ball on the green, without squatting or bending to the ground is provided. The apparatus contains a shaft having a setting end and a ball handling end. The setting end is adapted to releasably hold a golf ball and a golf tee and that selectively releases a golf ball onto a golf tee and inserts the golf tee into the turf. The ball handling end is adapted to pick up a golf ball or marker and includes a ball ejector. Preferably the device contains supports to allow the device to be self-standing and the supports contain a slot into which a golf tee may be inserted for removal from the turf after use.

19 Claims, 15 Drawing Sheets

METHOD AND APPARATUS FOR SETTING A GOLF BALL AND TEE AND FOR MANAGING A GOLF BALL ON THE GREEN

This is a non-provisional patent application based on and claiming priority of provisional patent application Ser. No. 60/082,188, filed Apr. 17, 1998 and entitled GOLF TEE AND BALL SETTER PROVIDING BALL MANAGEMENT ON THE GREEN.

TECHNICAL FIELD

This invention relates generally to devices used to aid golfers, and more particularly to a device that aids golfers in setting a golf ball and a golf tee into turf, and for managing a golf ball on the green, without requiring the user to squat or bend to the ground.

BACKGROUND OF THE INVENTION

Devices used to assist golfers in setting a golf ball and a golf tee are well known in the art. Some of these devices allow the user to set the golf ball and the golf tee without having to squat or bend to the ground. Golfers may prefer devices that eliminate or substantially reduce squatting and bending during golf ball and golf tee setting because such movement may be undesirable, difficult, or the golfer may have some type of physical limitation or handicap that prevents such movement.

Similarly, devices used to assist golfers in managing a golf ball on the green are well known in the art. Specifically, some such devices aid a golfer in replacing a golf ball with a marker, and replacing a marker with a golf ball between puts on the green. Some prior art devices allow the user to maneuver the golf ball and the marker in this manner without having to squat or bend to the ground. Golfers may prefer devices that eliminate or substantially reduce squatting and bending during golf ball management on the green because such movement may be undesirable, difficult, or the golfer may have some type of physical limitation or handicap that prevents such movement.

Despite advances made in the art over the years, the prior art does not reveal a single device that is used to set a golf ball and a golf tee, and to manage a golf ball on the green. Further, the golf ball and golf tee setting devices and the golf ball managing devices in the prior art exhibit other disadvantages. For example, many prior art devices are heavy in weight and/or large in size, making them difficult to maneuver and store. Many prior art devices are not self-standing and do not contain means to pick up a golf tee for possible salvage after use. In addition, many such devices require delicate care and special attention to place a golf ball on a golf tee and pick up a golf ball and a marker, rendering these tasks difficult and frustrating.

SUMMARY OF THE INVENTION

Accordingly, it is a primary object of the present invention to provide a device for setting a golf ball and golf tee and managing a golf ball on the green without requiring the user to squat or bend to the ground.

It is a further object of the present invention to provide a device for setting a golf ball and golf tee and managing a golf ball on the green which is lightweight, easily portable, self-standing and stores within a golf bag.

Another object of the present invention is to provide a device for setting a golf ball and golf tee and managing a golf ball on the green that also may be used to pick up a golf tee for possible salvage after use.

To achieve the foregoing and other objects, and in accordance with one aspect of the present invention, an improved device for setting a golf ball and golf tee and managing a golf ball on the green is provided. The device consists of a shaft having a ball handling end and a setting end. Preferably, the shaft is of sufficient length to allow a user to operate the device without squatting or bending to the ground. The ball handling end contains means to pick up a golf ball or marker. Preferably, the means to pick up a golf ball or marker is further comprised of a cup and ball ejection means. The setting end includes means to releasably hold a golf ball and a golf tee, and means for releasing a golf ball and a golf tee, such that a golf ball is placed upon a golf tee that is inserted into turf. Preferably, the means for releasably holding a golf ball and a golf tee is further comprised of clamping arms that selectively open and close to engage and disengage a golf ball and a golf tee as desired. Preferably, the shaft is rotatable, and is adapted such that rotating the shaft in a first direction causes the clamping arms to close, and that rotating the shaft in a second direction causes the clamping arms to open. Preferably, the device contains support means to allow the device to be self-standing. More preferably, the support means further contains means to pick up a golf tee, such as a slot, into which a golf tee may be inserted for removal from the turf and possible salvage after use.

In accordance with a further aspect of the present invention, a method of setting a golf ball and a golf tee without squatting or bending to the ground is provided. The method includes use of a device for setting a golf ball and golf tee having a shaft with a ball handling end and a setting end having clamping means and support means. The method includes the steps of placing a golf ball and a golf tee into the clamping arms; closing the clamping arms; positioning the setting end towards the turf; pushing the setting end to make contact with turf to insert a golf tee into turf; opening the clamping arms to release a golf ball and a golf tee; and lifting the device away from a golf ball and a golf tee.

In accordance with another aspect of the present invention, a method for managing a golf ball on the green without squatting or bending toward the ground is provided. The method includes use of a device for setting a golf ball and a golf tee and managing a golf ball on the green having a shaft with a setting end and a ball managing end having means for picking up a golf ball or marker and ball ejection means. The method includes the steps of placing a marker into means to pick up a golf ball or marker; positioning the ball handling end toward turf; releasing the marker adjacent a golf ball onto the turf with ejection means; picking up a golf ball with the means to pick up a golf ball or marker; releasing a golf ball adjacent a marker onto turf with ejection means; and picking up a marker with means to pick up a golf ball or marker.

Still other aspects and objects of the present invention will become apparent to those skilled in this art from the following description and drawings wherein there is described and shown preferred embodiments of this invention and the best modes contemplated for carrying out the invention. As will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification illustrate several aspects of the present invention, and together with the description and claims serve to explain the principles of the invention. In the drawings:

DETAILED DESCRIPTION OF THE PREFERRED EMBODIMENT

Figure 1:
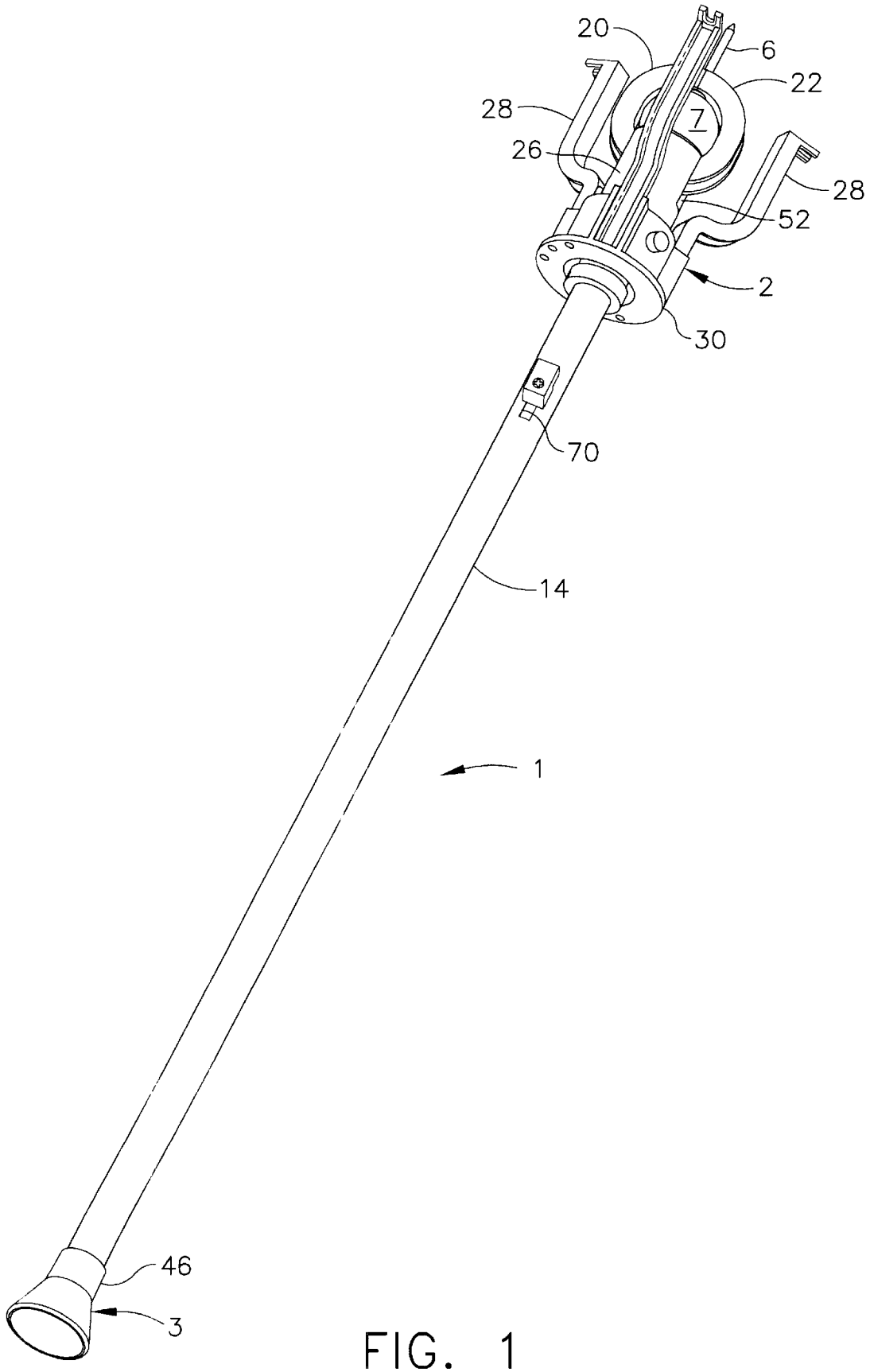
FIG. 1 is a perspective view of the device for setting a golf ball and a golf tee and managing a golf ball on the green in accordance with the present invention.
Figure 2:
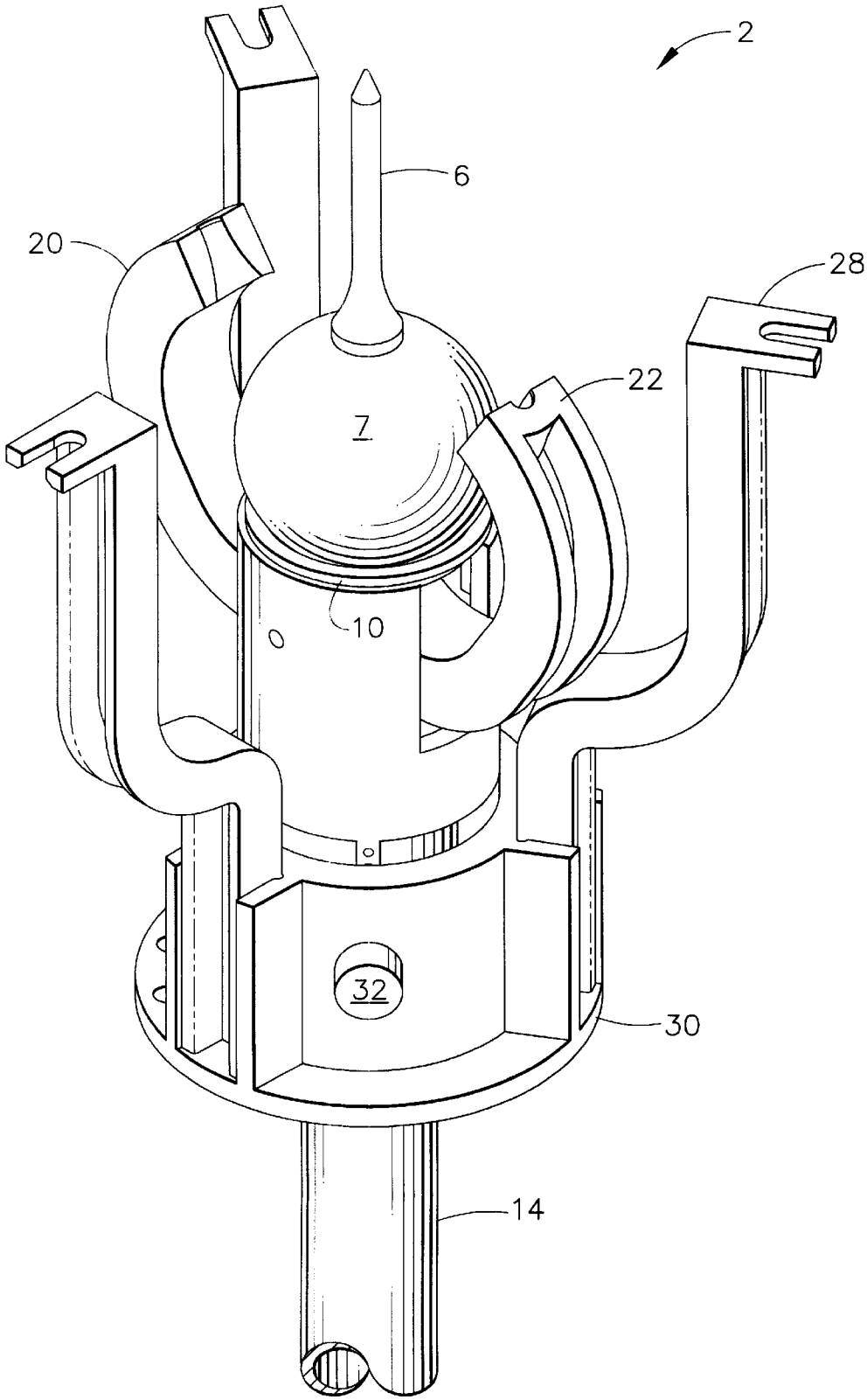
FIG. 2 is a perspective view of the setting end of the device of the present invention shown in an open position with a golf ball and a golf tee.
Figure 22:
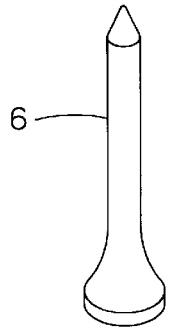
FIG. 22 is a perspective view a golf tee useable with the present invention.

Reference will now be made in detail to the present preferred embodiment of the invention, examples of which are illustrated in the accompanying drawings. Referring now to the drawings in detail, wherein like numerals indicate the same elements throughout the views, FIG. 1 shows the device for setting a golf ball and tee (see FIG. 22) and managing a golf ball on the green in accordance with the present invention. The device 1 comprises a shaft 14 having a ball and tee setting end 2 and a ball handling end 3.

Shaft 14 may be sized for an individual user's height. Preferably shaft 14 is of sufficient length to allow a user to set a golf ball and a golf tee, and manage a golf ball and a marker on the green (or other part of the golf course as necessary) without having to unnecessarily squat or bend to the ground. It should be understood that shaft 14 may be of any suitable length so as to accommodate the varying needs of individuals of different heights. Preferably, the shaft 14 will be about 40 inches long.

Figure 3:
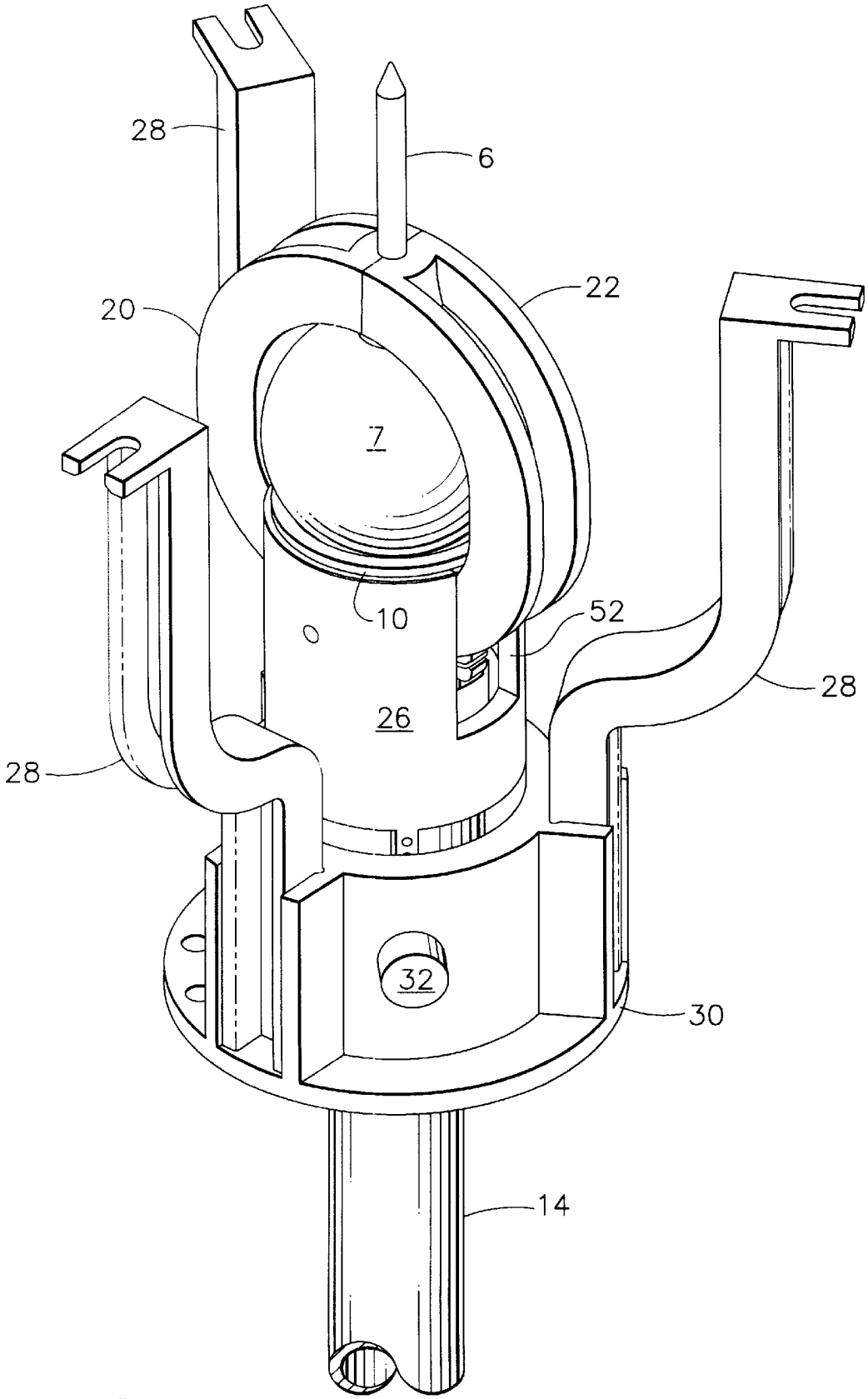
FIG. 3 is a perspective view of the setting end of the device of the present invention shown in a closed position with a golf ball and a golf tee.
Figure 4:
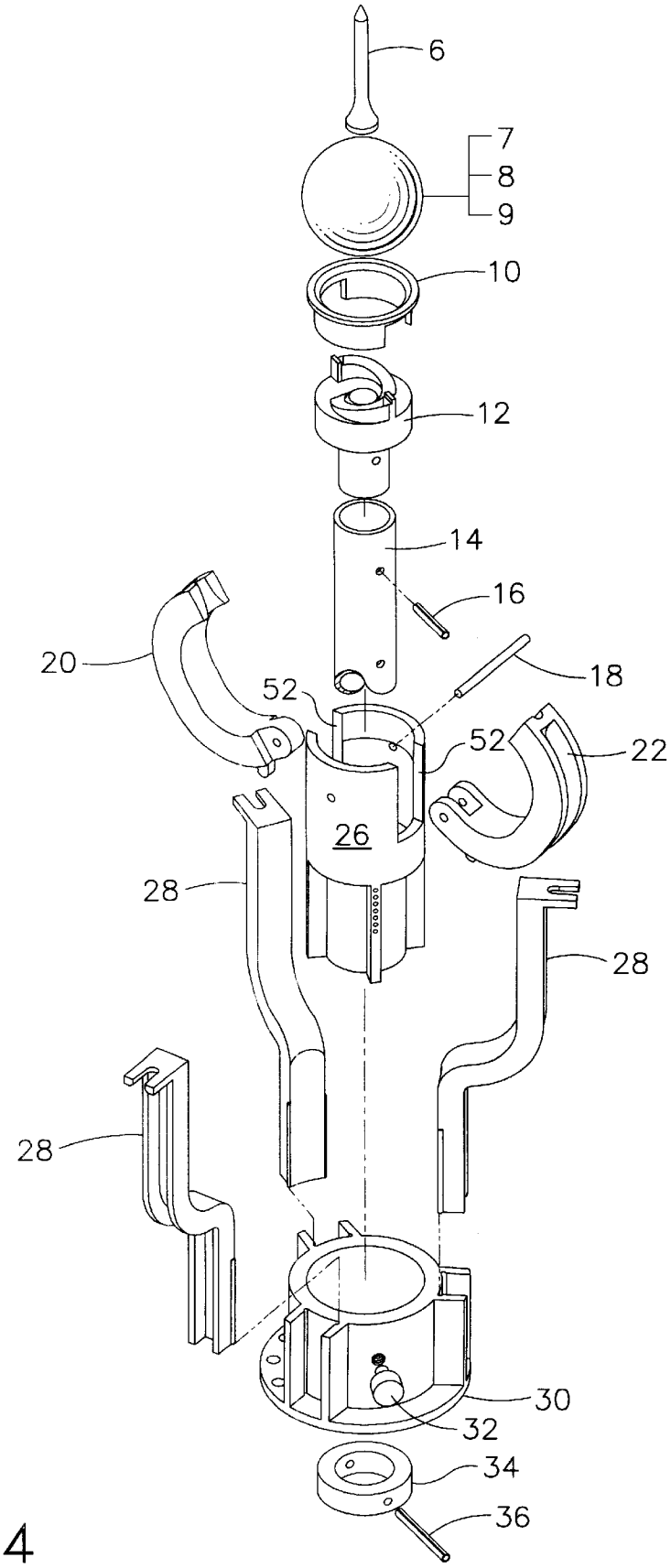
FIG. 4 is an exploded view of the setting end of the device displaying the relation of the parts forming the setting end.
Figure 5:
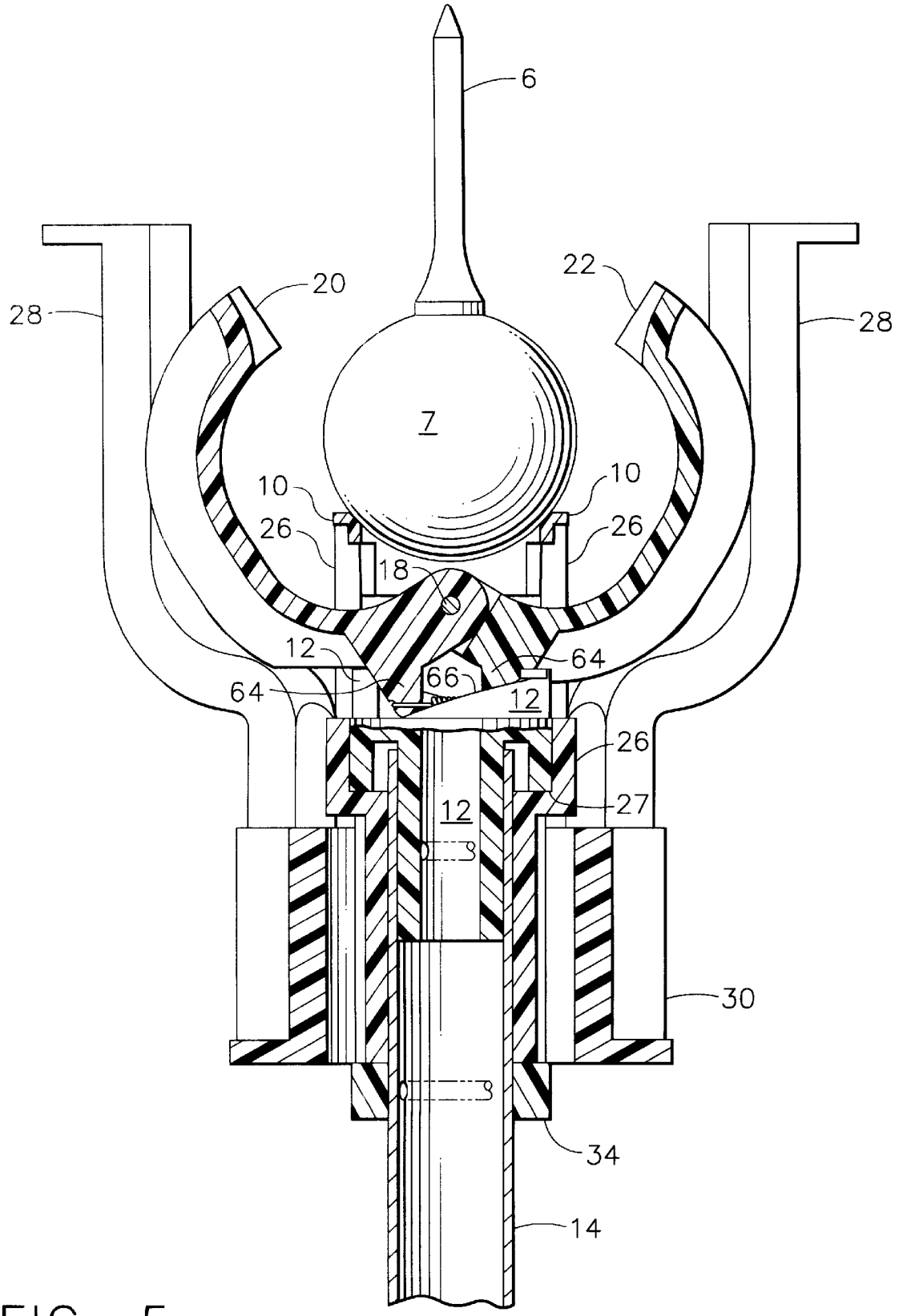
FIG. 5 is a cross-sectional view of the setting end of the device shown in an open position with a golf ball and a golf tee.
Figure 6:
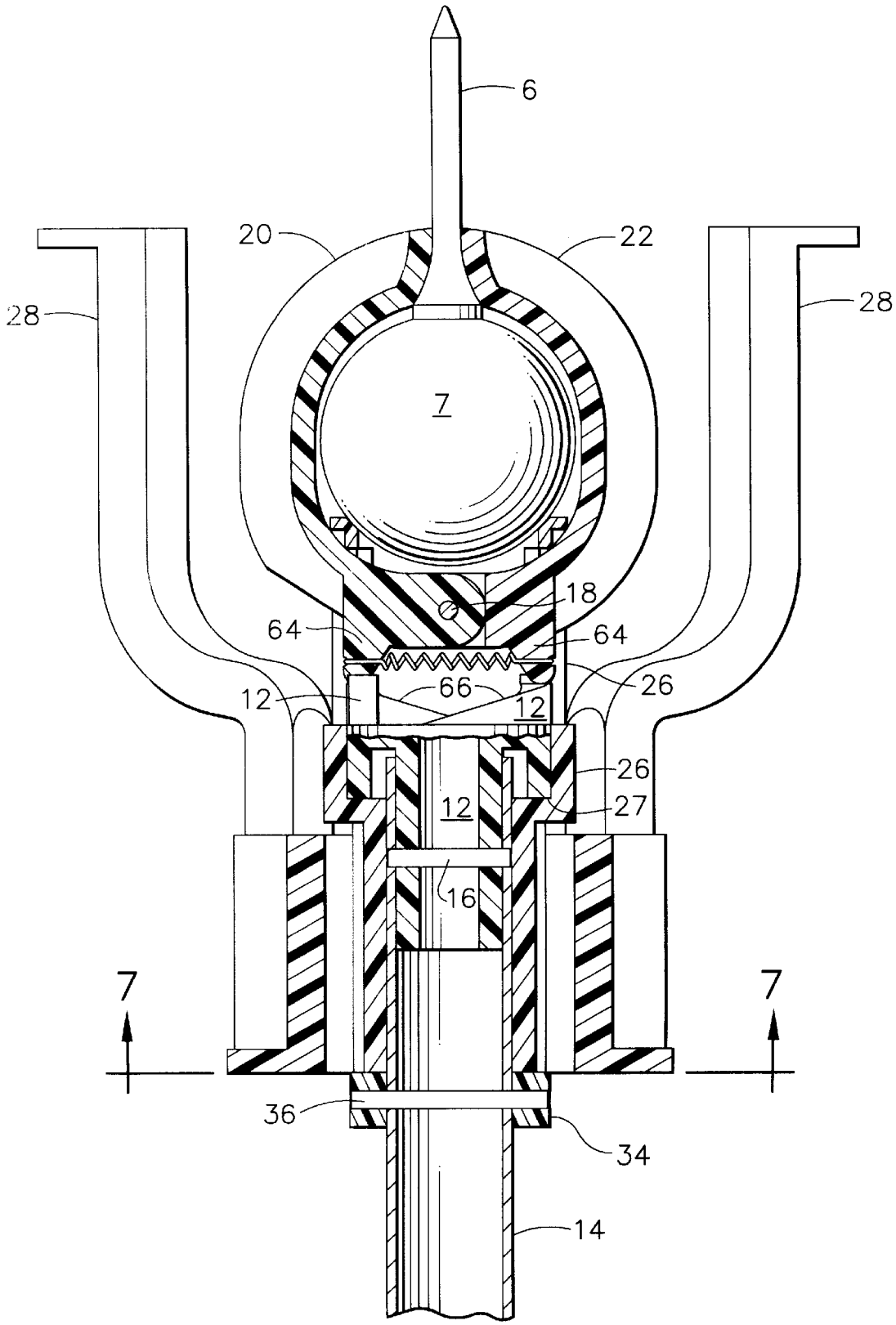
FIG. 6 is a cross-sectional view of the setting end in a closed position shown with a golf ball and a golf tee.
Figure 7:
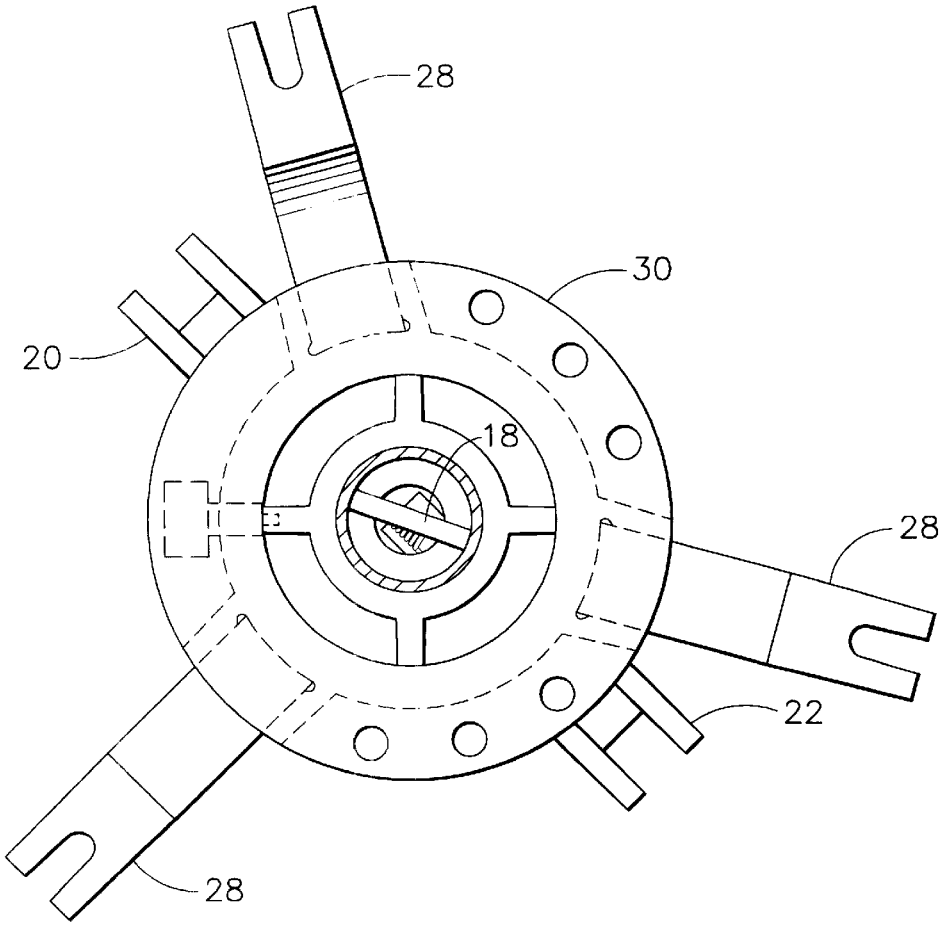
FIG. 7 is a bottom end view of the setting end showing the support means.

Referring now to FIGS. 2–6, the setting end 2 of the device 1 is depicted showing a golf tee 6 and a golf ball 7 disposed thereon. Setting end 2 comprises means for releasably holding tee 6 and ball 7, which further comprise a tubular body 26, a sleeve 12, a ring 10 and clamping arms 20 and 22, which are shown in an open position. When in a closed position, as shown in FIGS. 3 and 6, clamping arms 20 and 22 releasably hold tee 6 and ball 7. A user may place a ball 7 and tee (or a ball only) on ring 10 of the setting end 2 while standing, thus avoiding unnecessary and undesirable bending or stooping when placing a ball to tee off or drive. In order to releasably secure a ball and tee on the setting end 2, arms 20 and 22 are preferably manually closed by a user after the ball 7 and tee 6 have been properly aligned and positioned thereon.

Figure 18:
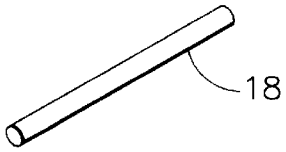
FIG. 18 is a perspective view of the pin for use with the tubular body of the present invention.

As best shown in FIGS. 4–6, and 11 the setting end 2 includes a tubular body 26 that is substantially cylindrical such that shaft 14 is capable of sliding engagement therein so that the tubular body 26 can rotate upon the shaft 14. The tubular body 26 may be of any suitable diameter and length and is preferably about 11/16 inches in diameter and 3 ¾ inches long. Tubular body 26 further includes two slots 52 into which clamping arms 20 and 22 are slidably disposed. Slots 52 provide sufficient clearance and space for clamping arms 20 and 22 to be inserted through the side walls of tubular body 26. As shown in FIG. 4, arms 20 and 22 are hingedly connected by means of pin 18 (see also FIG. 18). When arms 20 and 22 are so connected, they may be maneuvered into a closed or opened position as desired by a user so as to selectively disengage and engage tee 6 and ball 7.

As best shown in FIGS. 4–6 and 9, the setting end 2 of the device 1 of the present invention also includes a sleeve 12. Sleeve 12 comprises a first substantially cylindrical section of a relatively small diameter that is adapted to be inserted within shaft 14. Sleeve 12 further comprises a second cylindrical section of a relatively larger diameter that is seated on a lip 27 inside tubular body 26 (FIGS. 5 and 6). Sleeve 12, which is attached to shaft 14 with one or more pins 16 disposed in corresponding holes in sleeve 12 and shaft 14 (FIGS. 4, 6, 8 and 10), fits partially within tubular body 26 and makes contact with lip 27.

Figure 9:
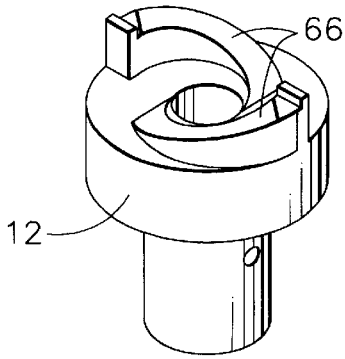
FIG. 9 is a perspective view of a sleeve in the setting end of the device of the present invention.
Figure 8:
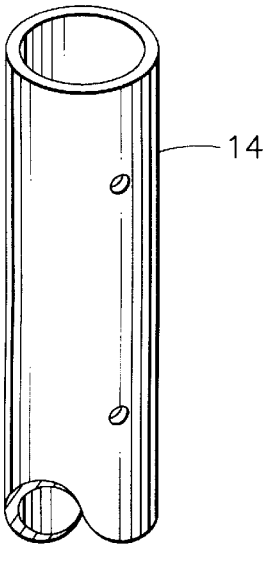
FIG. 8 is a perspective cutaway view of an end of the shaft of the present invention device.
Figure 10:
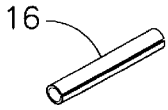
FIG. 10 is a perspective view of a pin that fastens the sleeve to the shaft of the device in accordance with the present invention.
Figure 11:
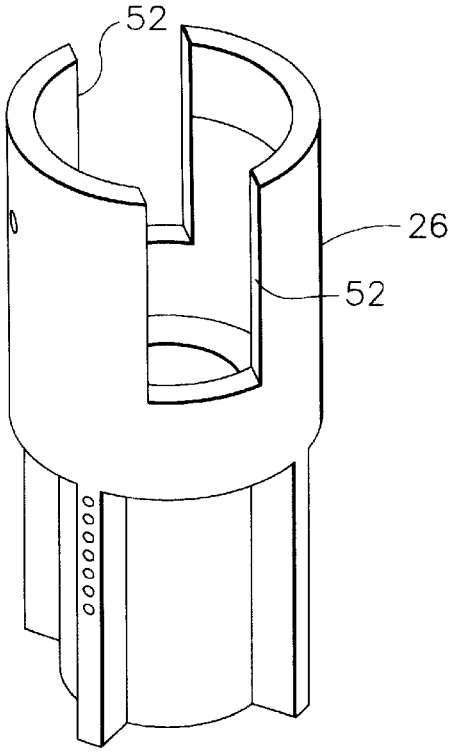
FIG. 11 is a perspective view of the tubular body in the setting end of the device of the present invention.
Figure 12:
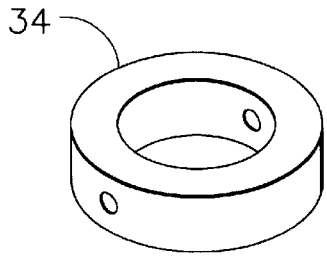
FIG. 12 is a perspective view of a collar found in the setting end of the device in accordance with the present invention.
Figure 13:
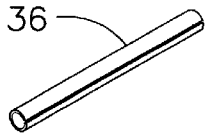
FIG. 13 is a perspective view of a pin that operates the clamp arms in the setting end in accordance with the present invention.
Figure 14:
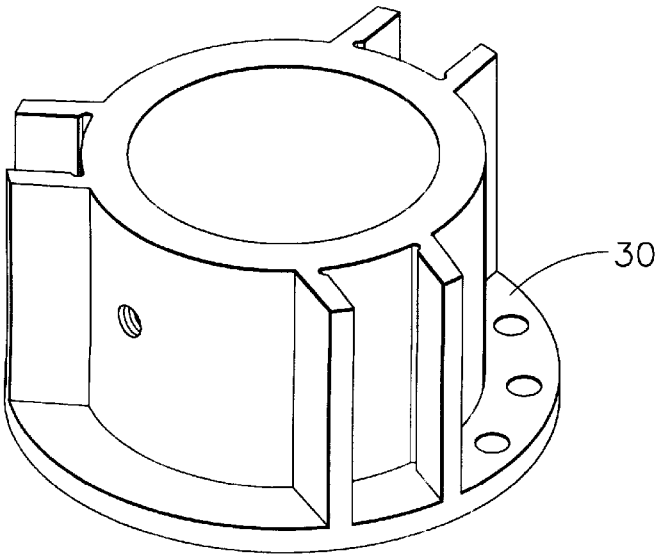
FIG. 14 is a perspective view of a sleeve for three legs that are part of the support means found in a preferred embodiment of the device of the present invention.
Figure 15:
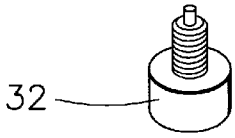
FIG. 15 is a perspective view of a ball height adjusting screw of the setting end of the present invention.
Figure 20:
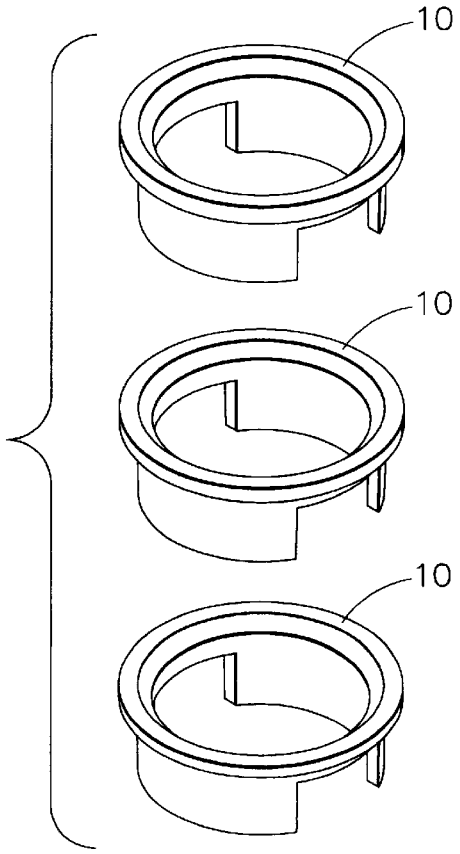
FIG. 20 is a perspective view of sleeves for different diameter golf balls for use with the setting end of the present invention.

As shown in FIG. 9, the sleeve 12 also comprises a pair of upstanding wedged shaped surfaces 66. Wedge shaped surfaces 66 face away from tubular body 26 when sleeve 12 is inserted into tubular body 26, as shown in FIG. 4. Ring 10 which serves to accept ball 7 is placed over sleeve 12 and has downwardly depending bottom edge portions that fit within sleeve 12 to hold ring 10 on sleeve 12. The ring 10 is pressed into tubular body 26 to cover the end of the tubular body 26. Ball 7 and tee 6 are placed upon ring 10 when the ball 7 and tee 6 are used with device 1. Ring 10 may be made of different diameters to accommodate different sized balls, as shown in FIG. 20.

As shown in FIGS. 1–6 and 16–17 clamping arms 20 and 22 are shaped to fit around ball 7 to releasably hold ball 7, and have indented tee receptacles 62 on their ends that fit around tee 6 to releasably hold tee 6 in place on ball 7. Tee receptacles 62 are preferably shaped to fit around the gradually widening part of the shank and head of tee 6 near its top.

Figure 16:
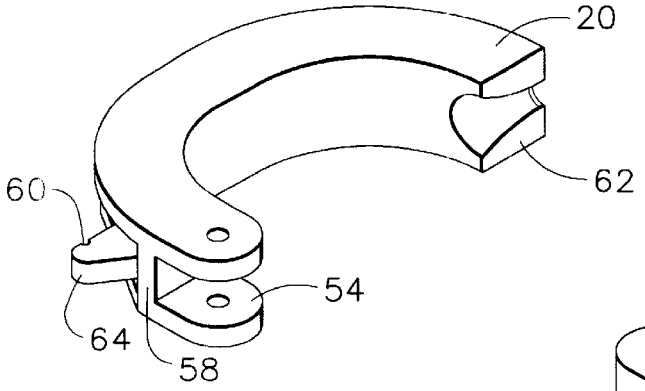
FIG. 16 is a perspective view of the clamping arm of the present invention.
Figure 17:
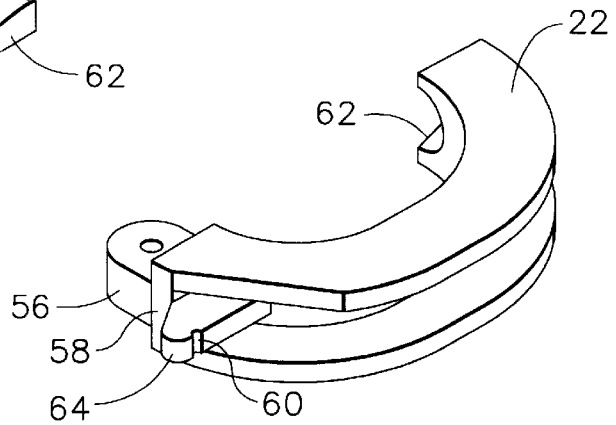
FIG. 17 is a second perspective view of a clamping arm of the present invention.

Clamping arms 20 and 22 are pivotally connected and supported within tubular body 26. As shown in FIGS. 16 and 17, clamping arms 20 and 22 have hinged ends 58. The alignment of clamping arms 20 and 22 is controlled by tongue 56 on hinged end 58 of clamping arm 22, which fits inside arm slot 54 on hinged end 58 of clamping arm 20. Pin 18 (FIG. 18) is placed through bores on tongue 56 and arm slot 54 to pivotally connect clamping arms 20 and 22.

Figure 19:
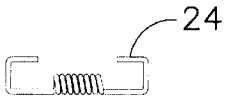
FIG. 19 is a perspective view of the clamping arm spring of the present invention.

As best shown in FIGS. 5–6 and 16–17, clamping arms 20 and 22 have spring lugs 64 with spring slots 60 on their hingedly connected ends 58. As shown in FIG. 5, lugs 64 are disposed on the low end of wedge shaped surfaces 66 when the arms 20 and 22 are in an open position. Tension spring 24 (FIG. 19) hooks into spring slots 60 on spring lugs 64 of clamping arms 20 and 22 to bias the arms open, as shown in FIG. 5. As described previously ball 7 and tee 6 may be engaged by arms 20 and 22 by manually closing the arms about the ball and tee. Preferably, the ball and tee may be engaged upon counterclockwise rotation of shaft 14. Rotating shaft 14 causes lugs to rotate along the length of wedge shaped surfaces 66 of the sleeve 12. This action causes the spring 24 to expand and causes the arms to move together and enclose the ball and tee as shown in FIG. 6. In this manner, tee 6 and ball 7 are held in place for setting into turf. Clockwise rotation of shaft 14 opens clamping arms 20 and 22 when the ball and tee have been placed into the turf allowing a user to place a ball on a tee in the turf without undue stooping or bending. Further, the spring 24 provides a biasing force that draws the lugs back down to the lower portion of wedge shaped portions 66 and that returns the arms 20 and 22 to an open position when the shaft is released after the ball and tee are placed in the turf.

As best shown in FIG. 9, the wedge shaped portions 66 on sleeve 12 include an upstanding stop at the top of each wedge shaped portion 66. This stop controls the amount of rotational movement of the shaft 14 when the lugs 64 engage the stops to prevent over rotation of the various components, in particular the clamping arms 20 and 22.

Figure 21:
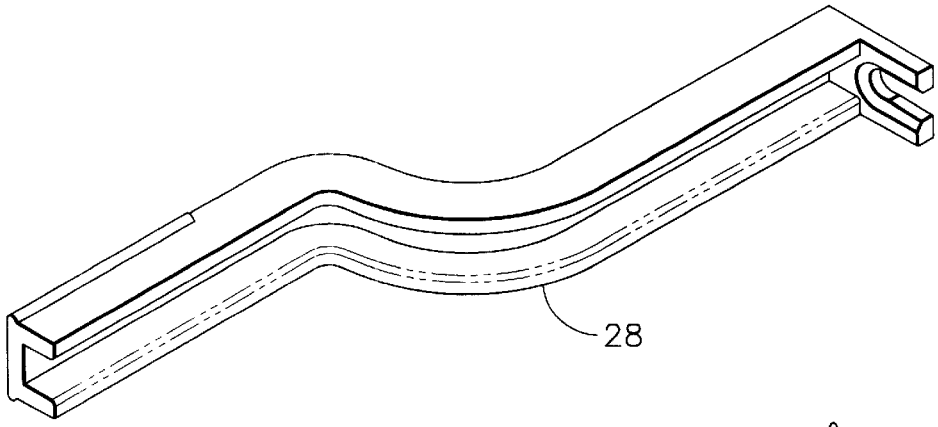
FIG. 21 is a perspective view of the leg that is part of the support means in a preferred embodiment of the present invention.

As shown is FIGS. 1–7, the setting end 2 also contains supporting means to allow the device 1 to be self-standing upon a substantially flat surface. The supporting means include support body 30 (FIG. 14) and legs 28 (FIG. 21). Preferably, there are three legs 28 and legs 28 are connected to support body 30 by seal fit or interface fit. As shown in the figures, the legs may include tee retrieval slot 68 adapted to capture and lift a tee after use. The device 1 may self-stand upon legs 28 on a relatively level surface. As shown in FIGS. 4–6 and 12–15, support body 30 accepts tubular body 26 and is adjustably mounted to shaft 14 with a support screw 32. The height that ball 7 is set above turf is adjusted by loosening screw 32 and lowering or raising support body 30 with respect to tubular body 26. Once support body 30 is in a desired position, screw 32 is tightened to maintain the height of support body 30 in relation to tubular body 26 and to maintain the height that ball 7 will be set above turf.

Collar 34, which is attached to shaft 14 with pin 36 (FIGS. 5 and 6), prevents tubular body 26 and support body 30 from sliding down shaft 14. Preferably, collar 34 and sleeve 12 allow tubular body 26 to rotate with respect to shaft 14, but limit play or axial motion of tubular body 26 with respect to shaft 14.

Figure 25:
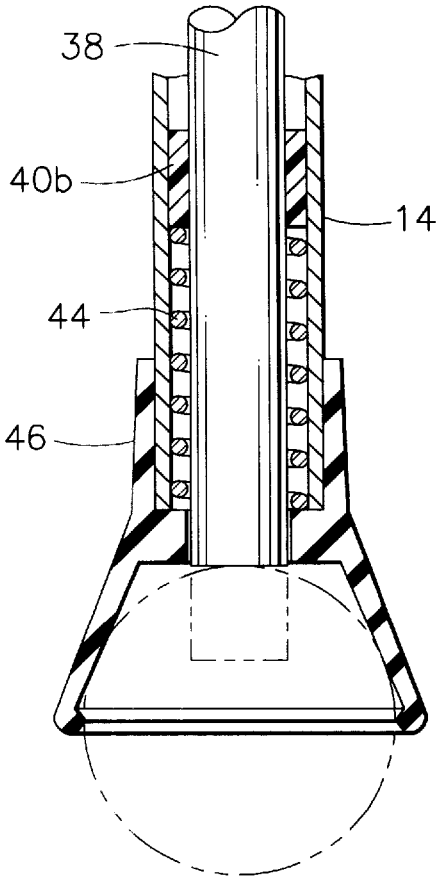
FIG. 25 is a cross-sectional view of the ball handling end of the device showing a compression spring and cup.
Figure 26:
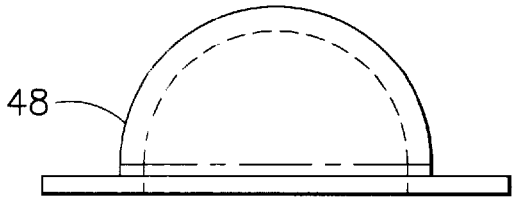
FIG. 26 is a side view of a ball marker useable with the device of the present invention.

According to another important aspect of the present invention, and as shown in FIG. 25, the ball handling end 3 of device 1 is comprised of a cup 46 that is sized and adapted to pick up ball 7. Cup 46 is typically made from a rubber or plastic. The ball may be retained in the cup 46 by a snap-fit, suction, frictional engagement, or any other suitable means as is known in the art.

The ball handling end 3, as best shown in FIGS. 1 and 23–25, further includes ball ejection means including an ejection tube 38 (FIGS. 23 and 25) that resides in shaft 14. Preferably ejection tube 38 is axially supported and spaced away from shaft 14 with bearings 40, so that it does not make direct contact with the inner surface of shaft 14 and to promote sliding engagement therebetween. Preferably two bearings, upper bearing **40*a* and lower bearing 40*b*, support and guide ejection tube 38 within shaft 14. In another embodiment, a biasing force may be maintained upon ejection tube 38 to hold ejection tube 38 in a retracted position such that ejection tube 38 does not enter cup 46 until actuated. A biasing spring 44, as shown in FIG. 25, may be placed between cup 46 and lower bearing 40*b*. Lower bearing is fixed to ejection tube 38 and engages biasing spring 44 to provide a retractive force to return ejection tube 38** back into its original position after the ball is ejected.

Figure 23:
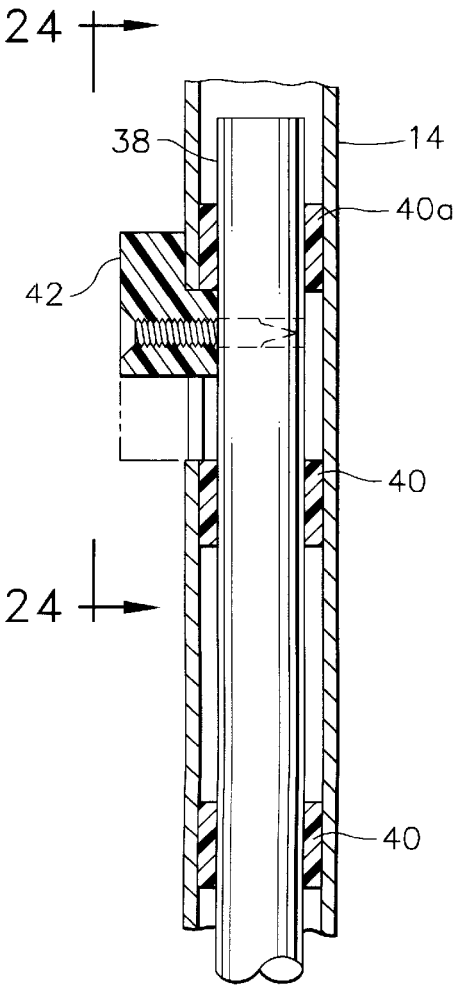
FIG. 23 is a cross-sectional view of the ball handling end of the present invention showing the bearings, the knob, and the ejection tube.
Figure 24:
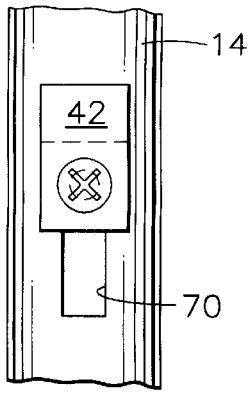
FIG. 24 is a top view of the knob for the ball handling end.

Ejection tube 38 is actuated upon movement of knob 42, which protrudes from and is accessed from opening 70 in shaft 14 (FIGS. 23 and 24). Opening 70 forms an elongate slit in shaft 14 such that pushing knob 42 toward the ball handling end 3 moves the end of ejection tube 38 into cup 42 to push ball 7 out of cup 46. Moving knob 42 toward the setting end 2 moves the end of ejection tube 38 back into shaft 14 and cup 42 may again be used to pick up ball 7 or marker 48. Preferably opening 70 is located near the setting end 2 of shaft 14 to allow the user to operate knob 42 without having to lean, squat or bend to the ground.

Device 1 may be used in a method for setting tee 6 and ball 7 on turf. When device 1 is placed in a vertical position with setting end 2 facing up, a user first places ball 7 on ring 10 and balances tee 6 upon ball 7. The user next closes clamping arms 20 and 22 to retain tee 6 and ball 7 and locks clamping arms 20 and 22 in a closed position by rotating shaft 14 in a counterclockwise direction or by manually closing arms about the ball. Next, the user positions the setting end 2 of device 1 toward turf and pushes setting end 2 toward turf legs 28 make contact with turf and tee 6 is inserted into turf. Next the user releases or rotates shaft 14 in a clockwise direction to unlock and open clamping arms 20 and 22 to release tee 6 and ball 7, such that ball 7 is placed upon tee 6, and tee 6 remains inserted into turf Preferably, clamping arms 20 and 22 simultaneously release tee 6 and ball 7. Finally the user lifts device 1 vertically away from tee 6 and ball 7. If desired, the user may pick up tee 6 from turf after use for possible salvage by positioning tee retrieval slot 68 on leg 28 around the head of tee 6 and lifting device vertically away from turf.

Device 1 may be used in a method for managing (i.e. alternately placing and retrieving a ball 7 and marker 48 as desired) ball 7 and marker 48 on the golf course. For example, when ball 7 is on the green and the user wishes to replace ball 7 with marker 48, the user first places marker 48 in cup 42. Marker 48 remains within cup 42 by snap-engagement, friction, suction, or any suitable retaining means (see FIG. 27). Next, the ball handling end 3 of the device 1 is positioned toward the green. When the ball handling end 3 is positioned such that marker 48 will be released adjacent ball 7, the user pushes knob 42 toward the ball handling end 3 of the device 1 to actuate the ejection tube 38 and release marker 48.

Next, the user moves knob 42 back toward the setting end 2 of the device 1 to replace the end of ejection tube 38 within shaft 14. The user picks up ball 7 with cup 42 as described previously. Cup 42 maintains ball 7 within it during transport off of the green by snap-engagement, friction, suction, or any suitable retaining means.

Figure 33:
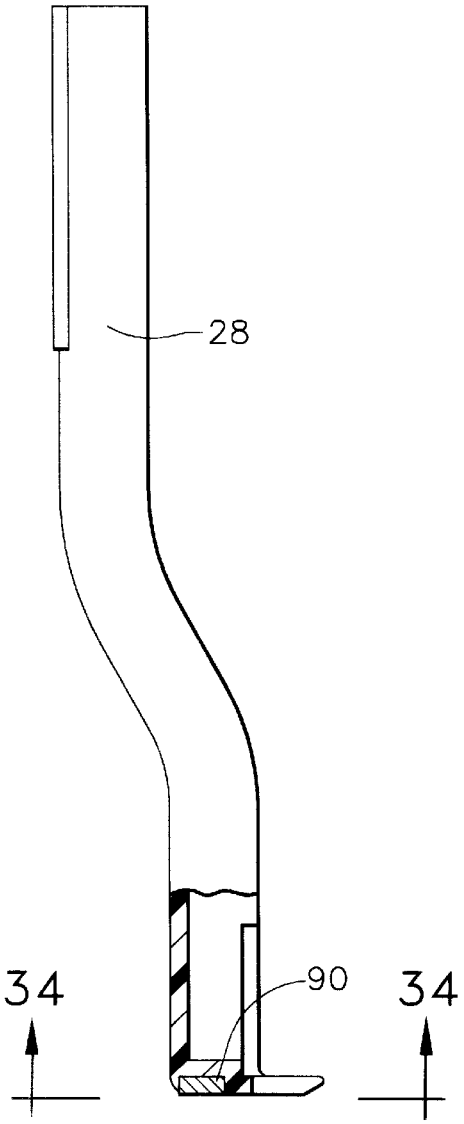
FIG. 33 is a partially cutaway side view of a leg that is part of the support means of a second preferred embodiment of the present invention showing a magnet at the base of the leg for retrieval of a ball marker.
Figure 34:
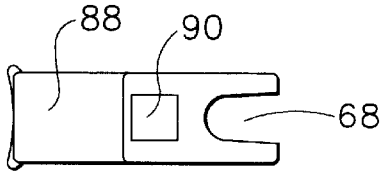
FIG. 34 is a bottom view of the leg shown in FIG. 33.

When the user wishes to replace marker 48 with ball 7, the user moves the ball handling end 3 of device toward the green such that ball 7, which is already within cup 42, may be released adjacent marker 48. When the ball handling end 3 is positioned such that ball 7 will be released adjacent marker 48, the user pushes knob 42 toward the ball handling end 3 of the device 1 to actuate the ejection tube 38 and release ball 7. Upon actuation, the end of ejection tube 38 moves into cup 42. Next, the user moves knob 42 back toward the setting end 2 of the device 1 to replace the end of ejection tube 38 within shaft 14. The user may pick up marker 48 with cup 42. More preferably, and as shown in FIG. 33, legs 28 may contain magnet 90. When marker 48 is made of magnetically sensitive material, magnet 90 may be used to pick up marker 48. Preferably marker 48 is made of metal. As shown in FIG. 34, legs 28 may contain magnet 90 and tee retrieval slot 68.

If desired, the user may place device 1 on a relatively flat surface, where it will self-stand with legs 28 when not in use. Device 1 may also be readily stored in a golf bag. The various components are preferably made of any suitable lightweight material of sufficient strength and durability. For example, lightweight metals and engineering thermoplastics are preferably used.

Figure 27:
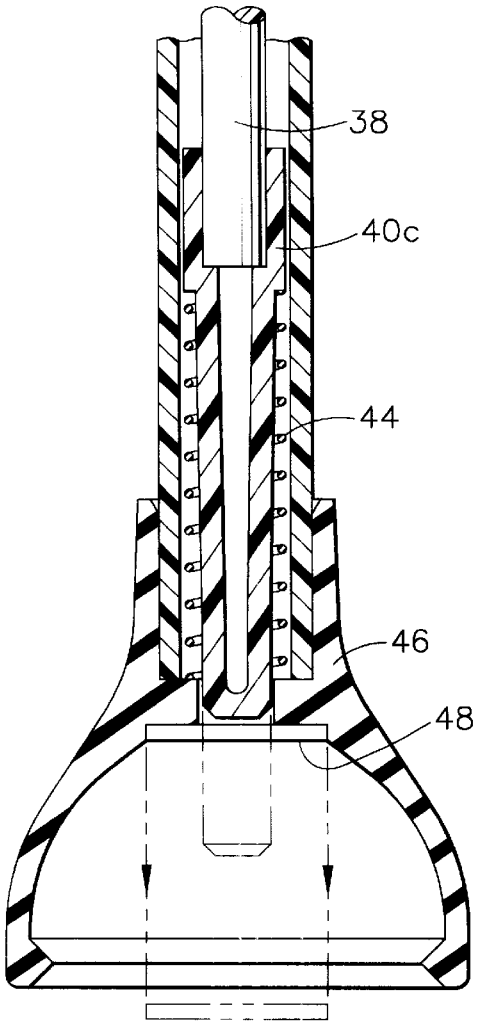
FIG. 27 is a cross-sectional view of a second preferred embodiment of the device of the present invention showing the ball handling.

As shown in FIG. 27, in a second embodiment, cup 46 may be shaped substantially dome shaped, as opposed to the substantially rectangular cup 46 shown in the first embodiment in FIG. 25. In this second embodiment, bearing **40*c* may be formed to fit over the end of ejection tube 38. Bearing 40*c* is positioned between ejection tube 38 and the inner surfaces of shaft 14 and narrows along shoulder portions and contains a narrow portion which sits inside biasing spring 44. The end of bearing 40*c* fits over the end of ejection tube 38 and enters cup 46 upon actuation of ejection tube 38. Preferably cup 46 and ejection tube 38** are made of an engineering thermoplastic.

Figure 28:
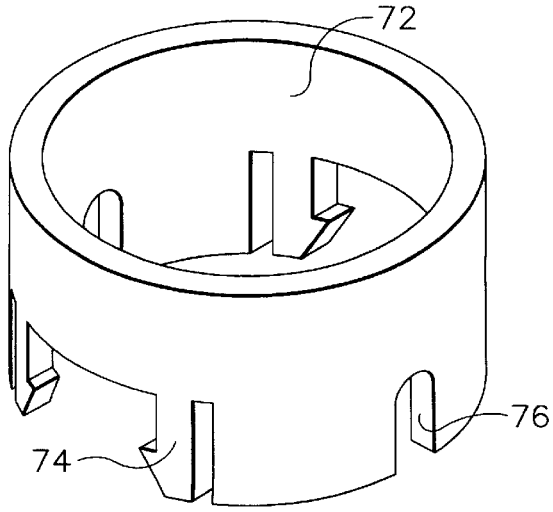
FIG. 28 is a perspective view of a ring for use with a second preferred embodiment of the device of the present invention.
Figure 29:
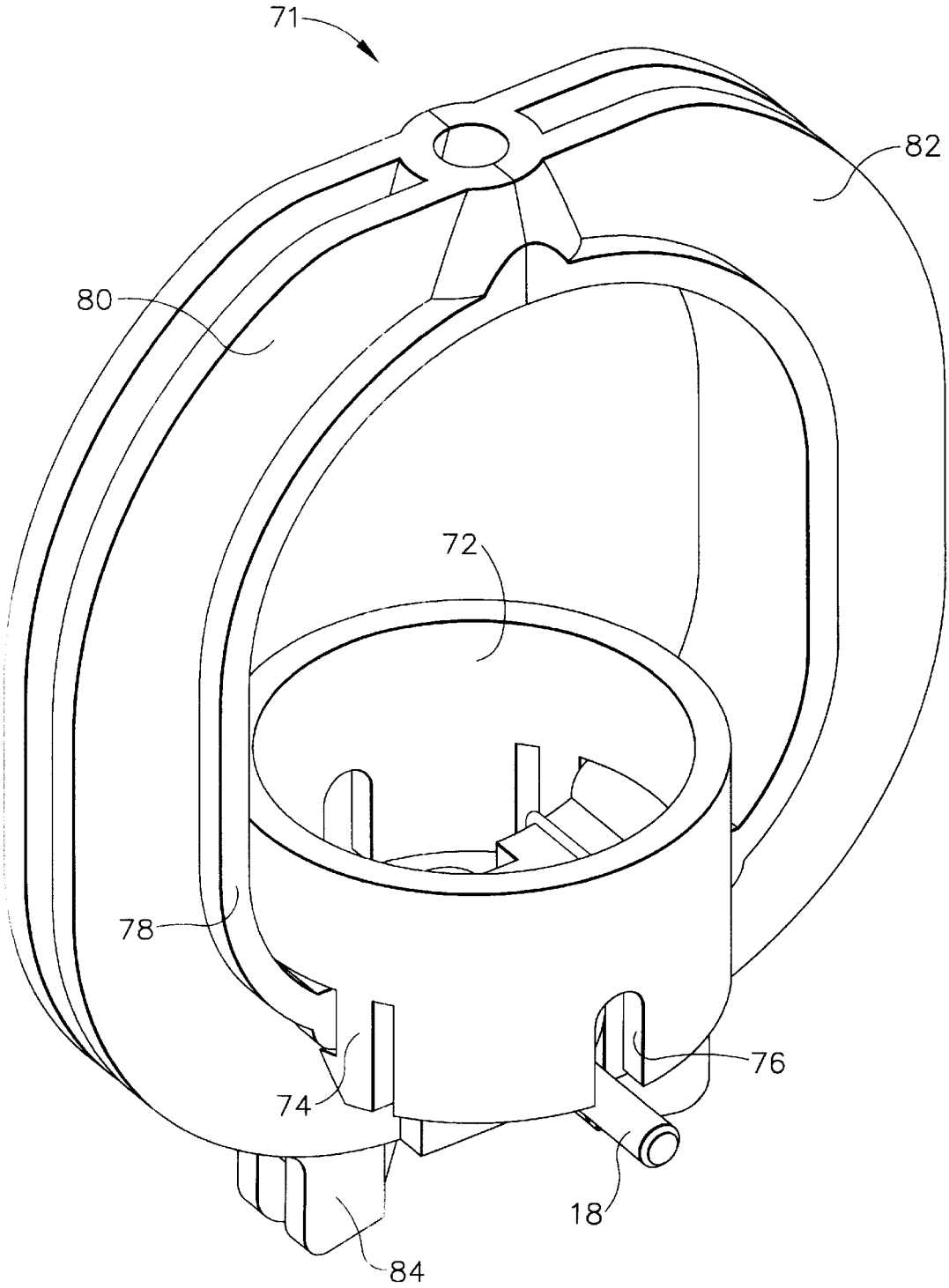
FIG. 29 is a perspective view of the clamping arms and ring of the setting end of second preferred embodiment of the device of the present invention shown in a closed position.

As shown in FIG. 29, in a second embodiment of the setting end of device 1, setting end 71 contains ring 72, which has ring arms 74 and ring slots 76 (FIG. 28). Ring 72 fits on clamping arms 80 and 82 and ball 7 is placed on ring 71. Ring arms 74 are shaped to fit around upstanding ridges 78 and clamping arms 80 an 82 and snap fit into place. As shown in FIG. 29, upstanding ridges 78 are located on the side surfaces of clamping arms 80 and 82, on their inner edges such that upstanding ridges 78 increase the width of the clamping arms 80 and 82 along their inner surfaces. Preferably there the two ring aims 74 that fit around upstanding ridges 78 on each clamping arm 80 and 82. Ring slots 76 are shaped to fit around pin 18, which pivotally connects clamping arms 80 and 82. Preferably there are two ring slots 76. Preferably clamping arms 80 and 82 are made of plastic.

Figure 30:
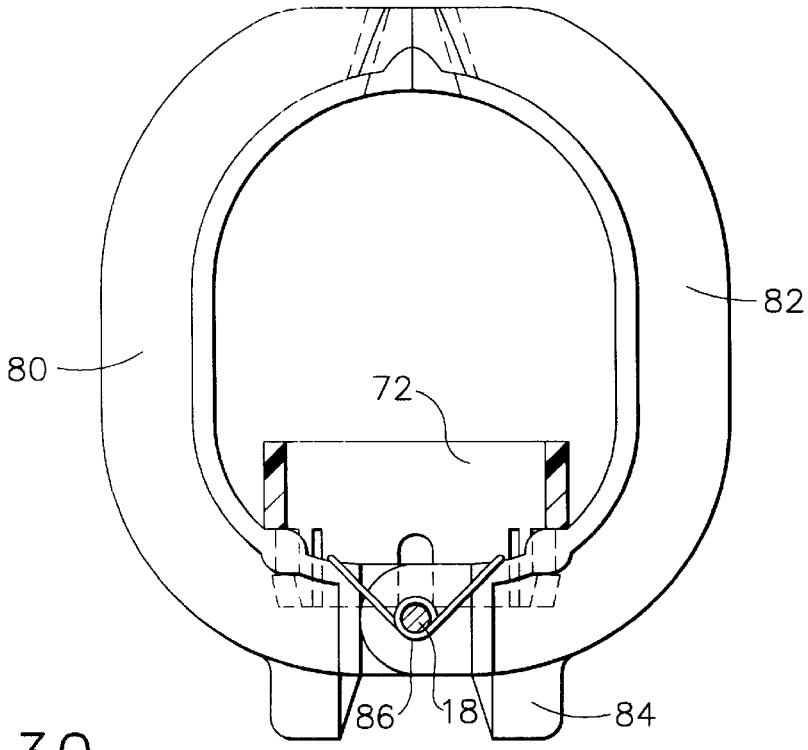
FIG. 30 is a partially cross-sectional side view of the setting end of a second preferred embodiment of the device of the present invention shown in a closed position.
Figure 31:
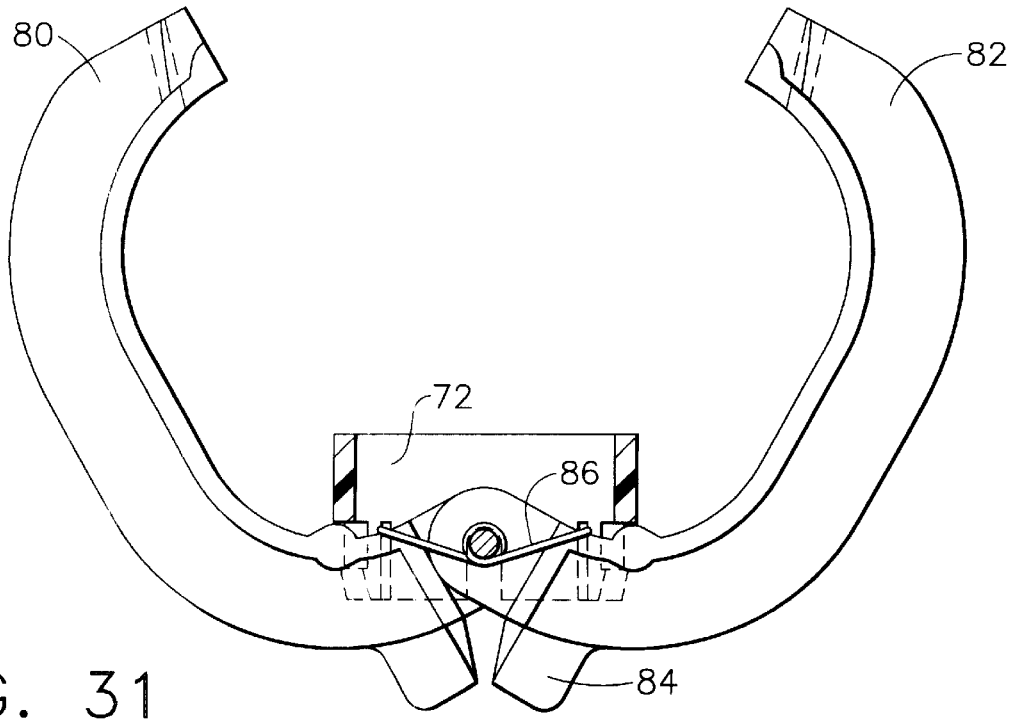
FIG. 31 is a partially cross-sectional side view of the setting end of a second preferred embodiment of the device of the present invention shown in an open position.

As shown in FIGS. 30 and 31, hinge spring 86 applies an inwardly directed biasing force upon clamping arms 80 and 82 to hold them closed until clamping arms 80 and 82 are manually opened. Clamping arms 80 and 82 also may contain stops 84. Which prevent over rotation of clamping arms 80 and 82.

Figure 32:
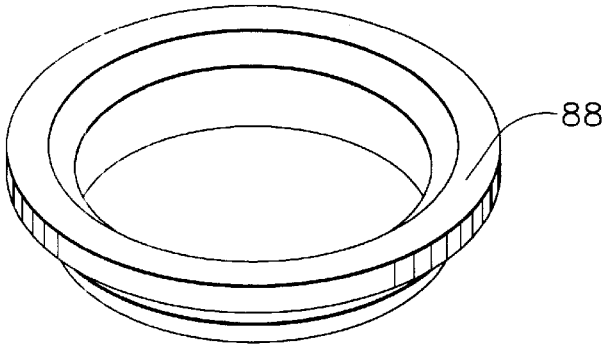
FIG. 32 is a perspective view of a ring insert for use with smaller diameter golf balls which may be seated in the ring of the second preferred embodiment of the device of the present invention.

An insert ring 88 may be placed over ring 72, as shown in FIG. 32. Insert ring 88 may have different diameters to accommodate golf balls of varying diameters. Preferably insert ring 88 is sized to accommodate a golf ball with a smaller diameter. Insert ring 88 has lower portions, which fit inside ring 72. Ball 7 rests upon insert ring 88. Preferably insert ring 88 is made of an engineering thermoplastic.

In summary, numerous benefits have been described which result from employing the concepts of the invention. The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

What is claimed is:

1. A device for setting a golf ball and a golf tee and managing a golf ball on the green comprising:

a shaft having a ball handling end and a setting end;

said ball handling end having means to pick up a golf ball, said ball handling end further comprising marker handling means disposed thereon;

said setting end having means to releasably hold a golf ball and a golf tee, said holding means further being adapted to be releasably fixed in a closed position so as to hold said ball and tee at least partially within said holding means, said holding means further being adapted to be releasably fixed in said closed position without requiring a user to apply constant force to said holding means and means for releasing a golf ball and a golf tee wherein said means for releasing places a golf ball on a golf tee and inserts a golf tee into turf; and said shaft being of sufficient length to allow a user to operate said device without squatting or bending to the ground.

2. The device of claim 1 wherein said setting end further comprises support means, and said support means allows said setting device to stand upon a surface.

3. The device of claim 2 wherein said support means allows said means for releasing to insert a golf tee into turf substantially perpendicular to the turf.

4. The device of claim 2 wherein said support means further comprises means for picking up a golf tee.

5. The device of claim 4 wherein said means for picking up a golf tee further comprises a slot, said slot being able to accept a golf tee therein and maintain a golf tee therein for transport out of turf.

6. The device of claim 2 wherein said support means further comprises at least three legs.

7. The device of claim 1 wherein said means to releasably hold a golf ball and a golf tee further comprises clamping means.

8. The device of claim 7 wherein said shaft is rotatable, said shaft rotating in a first direction to close said clamping means and said shaft rotating in a second direction to open said clamping means.

9. The device of claim 1 wherein said means for releasing simultaneously places a golf ball upon a golf tee and inserts a golf tee into turf.

10. The device of claim 1 wherein said setting end further comprises means for maintaining the placement height of a golf ball and a golf tee above turf.

11. The device of claim 1 wherein said setting end further comprises means for adjusting the placement height of a golf ball and a golf tee above turf.

12. The device of claim 1 herein said means to pick up a golf ball or marker further comprises a cup, said cup being able to accept a golf ball or marker therein, and said cup being able to maintain a golf ball or marker therein.

13. The device of claim 1 wherein said ball handling end further comprises ball ejection means.

14. The device of claim 1 wherein said device fits into a golf bag.

15. A method of setting a golf ball and a golf tee into turf without squatting or bending to the ground, using a device for setting a golf ball and a golf tee and managing a golf ball on the green having a shaft with a ball handling end and a setting end having means for releasably holding a golf ball and a golf tee, said ball handling end further comprising marker handling means disposed thereon, said holding means further being adapted to be releasably fixed in a closed position so as to hold said ball and tee at least partially within said holding means, said holding means further being adapted to be releasably fixed in said closed position without requiring a user to apply constant force to said holding means comprising the steps of:

placing a golf ball and a golf tee in said means for releasably holding a golf ball and a golf tee;

closing said means for releasably holding a golf ball and a golf tee;

positioning said setting end toward turf;

pushing said setting end into turf to insert a golf tee into turf;

opening said means for releasably holding a golf ball and a golf tee to release a golf ball onto a golf tee and to release a golf tee; and lifting said device vertically away from a golf ball and a golf tee.

16. The method of claim 15 further comprising the step of removing a golf tee from turf wherein said device comprises means for picking up a golf tee on said setting end.

17. The method of claim 15 further comprising the steps of rotating said shaft in a first direction to lock said means for releasably holding a golf ball and a golf tee, and rotating said shaft in a second direction to unlock and open said means for releasably holding a golf ball and a golf tee.

18. A method of managing a golf ball without squatting or bending toward the ground, using a device for setting a golf ball and a golf tee and managing a golf ball on the green having a shaft with a setting end and a ball handling end having means to pick up a golf ball, said ball handling end further comprising marker handling means disposed thereon, said ball handling end further comprising ejection means, comprising the steps of:

placing a marker into said means to pick up a golf ball;

positioning said ball handling end toward turf;

releasing a marker adjacent a golf ball on turf with said ejection means;

picking up a golf ball with said means to pick up a golf ball;

releasing a golf ball adjacent said marker onto turf with said ejection means; and picking up a marker with said marker handling means.

19. The device of claim 1 wherein said setting end further comprises means for adjusting the depth of which a golf tee is driven into turf, said adjusting means adapted to be selectively set by a user to one of a plurality of predetermined and discrete depth settings.

* * * * *